United States Patent [19]

Hufford et al.

[11] 3,950,722

[45] Apr. 13, 1976

[54] VARIABLE RESISTANCE CONTROL

[75] Inventors: James N. Hufford, Elkhart, Ind.; John Zdanys, Edwardsburg, Mich.

[73] Assignee: CTS Corporation, Elkhart, Ind.

[22] Filed: July 1, 1974

[21] Appl. No.: 484,599

[52] U.S. Cl. ..... 338/150; 338/120; 338/174

[51] Int. Cl.[2] ..... H01C 9/02

[58] Field of Search ..... 338/120, 150, 152, 162, 338/174

[56] References Cited

UNITED STATES PATENTS

| | | | |
|---|---|---|---|
| 2,823,287 | 2/1958 | Klose | 338/150 X |
| 2,877,328 | 3/1959 | Bourns | 338/152 |
| 2,894,237 | 7/1959 | Haynman | 338/150 X |
| 3,251,016 | 5/1966 | Manetti et al. | 338/150 X |
| 3,475,714 | 10/1969 | Wellard et al. | 338/150 X |
| 3,564,476 | 2/1971 | Barden | 338/152 X |
| 3,576,510 | 4/1971 | Bruder | 338/150 |
| 3,585,559 | 6/1971 | Rosema et al. | 338/174 X |
| 3,639,878 | 2/1972 | Scheel | 338/174 |
| 3,657,688 | 4/1972 | Casey et al. | 338/150 |
| 3,750,078 | 7/1973 | Bruder | 338/150 |

*Primary Examiner*—Volodymyr Y. Mayewsky

[57] ABSTRACT

A variable resistance control employing a support plate and a resistance element having a pair of spaced resistance paths applied on a base and rotatably mounted on the support plate. A pair of terminals with integral contacts are secured to the support plate and are disposed intermediate the base and the support plate. The pair of resistive paths are concentrically disposed on a surface of the base and electrically connected to each other. Each of the contacts engages a respective one of the resistive paths. In the assembly of the control, terminals are initially joined by a bridging member and, after the terminals are secured to the support plate, the bridging member is severed from the terminals providing a pair of separate terminals with integral contacts.

9 Claims, 7 Drawing Figures

VARIABLE RESISTANCE CONTROL

The present invention relates to electrical controls and, more particularly, to a variable resistance control and to a method for making same.

In many variable resistor control applications, in particular those applications requiring variable resistors of small size, it is often difficult to handle and assemble the component parts. A simple design with a minimum number of parts and assembly steps becomes of prime importance in producing an economical control. Prior art variable resistance controls such as disclosed in U.S. Pat. No. 3,657,688 generally comprise a base carrying a resistive path, a contactor engaging the resistive path, a conductive path carried by the base often overlying an end of the resistive path and contact means engaging the conductive path. Applying the resistive and conductive paths to the base requires two separate operations. Any extra operations, particularly when handling extremely small components can be very costly and time consuming. It would, therefore, be desirable to provide a variable resistance control having a pair of contacts engaging a pair of electrically connected resistive paths carried on a surface of a base.

To reduce the number of component parts in a variable resistance control, prior art devices such as disclosed in U.S. Pat. No. 3,581,265 provide a rotating contactor element engaging a resistive path and a conductive path carried by a base. However, in addition to the need to apply the conductive paths to the base in these controls, it is often necessary to provide separate terminals connected to the conductive paths to connect the control to an external circuit. Prior art devices such as disclosed in U.S. Pat. No. 2,894,237 and the above mentioned U.S. Pat. No. 3,657,688 provide integral terminal and contact means engaging a rotatable resistance element. However, although these controls eliminate the need for separate terminals, these controls are still relatively complex. It is necessary to align and secure the resistance element and the terminal and contact means to separate housing members and then to secure the housing members together. These additional operations are relatively uneconomical. It would therefore be desirable to provide a relatively inexpensive variable resistance control and method of making same wherein a single support plate secures both a rotatable resistance element and a pair of terminals with integral contacts in electrical engagement with the element.

Accordingly, it is an object of the present invention to provide a new and improved variable resistance control.

Another object of the present invention is to provide a new and improved variable resistance control having a pair of electrically connected resistive paths carried on a surface of a base in engagement with a pair of contacts.

A still further object of the present invention is to provide a variable resistance control employing a support plate rotatably securing a resistance element and integral terminal and contact means thereto wherein the contact means are disposed intermediate the support plate and a resistance element.

Another object of the present invention is to provide an insulative frame carrying a shaft and a post on a surface thereof for securing a rotatable resistance element and contact means into electrical engagement.

Another object of the present invention is to provide an insulative frame with a post and contact means with a notch wherein the post engages the notch to align the contact means on the frame and a portion of the post secures the contact means to the frame.

Another object of the present invention is to provide a new and improved variable resistance control having a base providing an electrically nonconductive surface comprising a plurality of resistive paths simultaneously applied on one side thereof in spaced relationship and engaging respective contacts.

Further objects and advantages of the present invention will become apparent as the following description proceeds and the features of novelty characterizing the invention will be pointed out with particularity in the claims annexed to and forming a part of this specification.

Briefly, the present invention is concerned with a variable resistance control comprising a support plate with an integral shaft, a rotatable resistance element secured to the shaft and a pair of contact members with integral terminals disposed intermediate the support plate and the resistance element. The terminals are secured to the support plate. The resistance element comprises a base with a pair of electrically connected and spaced resistive paths on a surface thereof, each of the contact members engaging a respective resistive path. In the assembly of the control, the resistive paths are simultaneously applied on a surface of the base about an aperture and a conductive member comprising the contact members, integral terminals and a bridging member joining the terminals is secured to the support plate. The resistance element is then secured to the shaft with the contact members disposed intermediate the support plate and the resistance element. The bridging member is then severed providing two separate contact members.

For a better understanding of the present invention, reference may be had to the accompanying drawings, wherein the same reference numerals have been applied to like parts and wherein.

Figure 1:
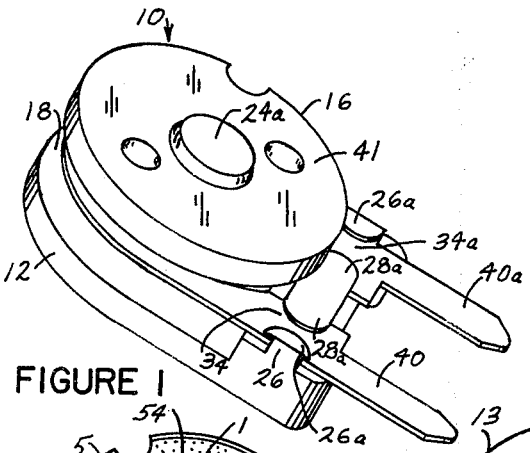
FIG. 1 is an isometric view of a variable resistance control built in accord with the present invention.

Referring now to the drawings, there is illustrated a variable resistance control generally indicated at 10 comprising a support plate 12, a conductive member 13 defining a pair of contact members 14 and **14*a* and a rotatable resistance element 16 secured to the support plate and electrically engaging the contact members 14 and 14*a***.

Figure 4:
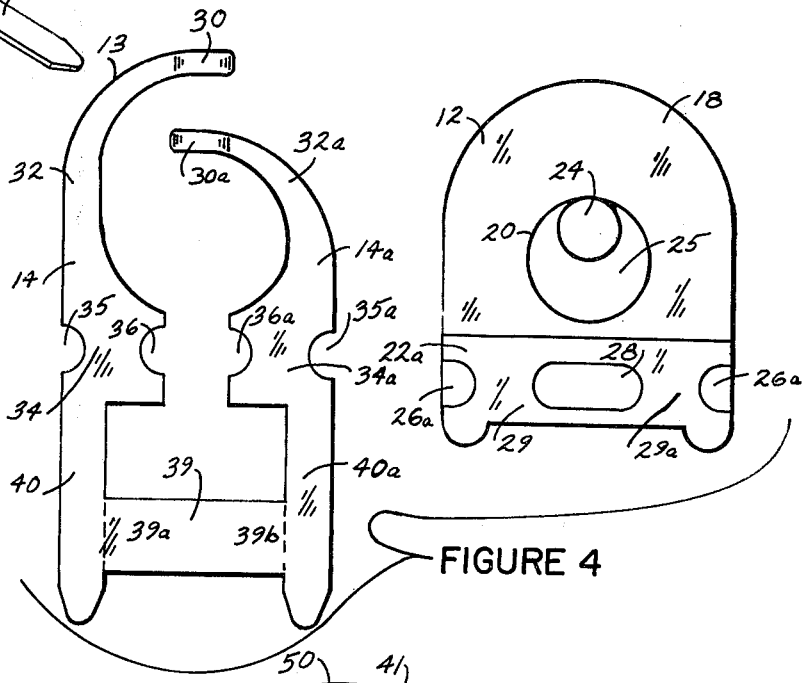
FIG. 4 is a top plan view of the support plate and the conductive member before attachment of the conductive member to the support plate.
Figure 5:
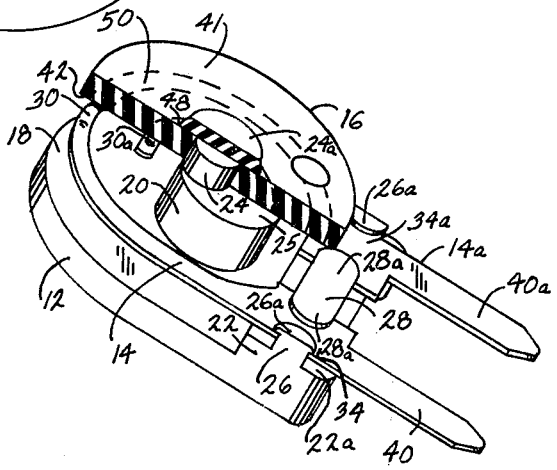
FIG. 5 is an isometric view of the control shown in FIG. 1 with a portion of the resistance element broken away.

Considering first the support plate 12, it preferably is of a one-piece molded construction of suitable electrically nonconductive material, such as plastic, with a first surface 18 supporting an integral hub 20 and an integral block 22 provided with a top surface 22*a*, the support plate 12 defining a generally semicircular configuration. Extending eccentrically from the hub 20 is a shaft 24 defining a shoulder 25 and extending integrally from the block 22 are a pair of end posts 26 and a center post 28, as best seen in FIGS. 4 and 5, the center post and end posts 26 and 28 defining a pair of channels 29 and 29*a*.

The contact members 14 and 14*a* are blanked and formed from spring tempered brass or other suitable material. Each of the contact elements 14 and 14*a* as best seen in FIG. 4, comprises a contact 30 and 30*a* and a spring arm 32 and 32*a* integral with each of the contacts 30 and 30*a*. Attachment segments 34 and 34*a* integral with the spring arms 32 and 32*a* are received in respective channels 29 and 29*a* and rest upon the top surface 22*a* of the block 22. Terminals 40 and 40*a* extend integrally from the attachment segments 34 and 34*a* for electrically connecting the variable resistance control 10 to an external circuit. A bridging member 39 as seen in FIG. 4 is attached to terminals 40 and 40*a* and provides means to handle and assemble the contact members 14 and 14*a* as an integral unit. In accord with the present invention, the attachment segments 34 and 34*a* are each provided with a pair of notches 35, 36 and 35*a*, 36 *a* for aligning with and engaging end posts 26 and center post 28 upon assembly of the contact members 14 and 14*a* to the support plate 12. Each of the notches 35 and 35*a* engage a respective end post 26 and the notches 36 and 36*a* engage respective ends of the center post 28. The attachment segments 34 and 34*a* abut the block 22 with attachment segment 34 disposed in channel 29 and attachment segment 34*a* disposed in channel 29*a*. Portions 26*a* and 28*a* of the end posts 26 and center post 28 are heat swaged against the attachment segments 34 and 34*a* to rigidly secure the attachment segments 34 and 34*a* to the block 22. With the securement of the resistance element 16 to the support plate 12 to be hereinafter described, the resistance element 16 pushes the contacts 30 and 30*a* and spring arms 32 and 32*a* downwardly toward the surface 18 of the support plate 12 with the spring arms 32 and 32*a* biasing the contacts 30 and 30*a* into engagement with the resistance element 16. After attachment of the integral unit comprising the contact members 14 and 14*a* to attachment segments 34 and 34*a* and after attachment of the resistance element 16 to the support plate 12, the bridging member 39 is severed from the terminals 40 and 40*a* as indicated by lines 39*a* and 39*b* as seen in FIG. 4 leaving individual contact members 14 and 14*a* as best seen in FIG. 5.

Figure 2:
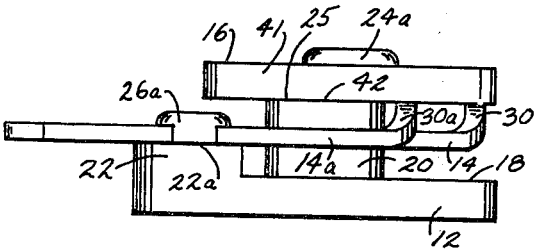
FIG. 2 is a side view of the control shown in FIG. 1.
Figure 3:
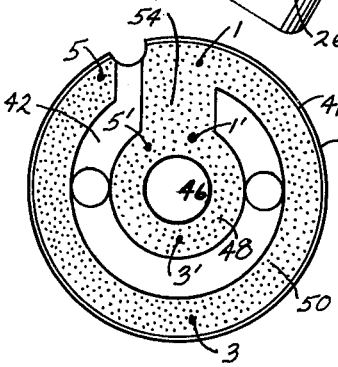
FIG. 3 is a bottom plan view of the resistance element of the variable resistance control shown in FIG. 1.

The resistance element 16 comprises a base 41 preferably of laminated plastic or other suitable dielectric material provided with a first surface 42 and a center aperture 46. In accord with the present invention, deposited in concentric relationship on the surface 42 are a closed circular resistive film or path 48 and an arcuate or open circular resistive path 50 as best seen in FIG. 3 with the resistive path 50 disposed around the periphery of the base 41 and the resistive path 48 disposed about the center aperture 46. A third resistive path 54 connects the resistive path 48 with one end of resistive path 50. The resistive paths 48, 50, and 54 preferably are of a carbon composition or any other suitable resistive material and are applied to the base 41 in any suitable manner well known in the art. To secure the resistance element 16 to the support plate, the shaft 24 is inserted through the center aperture 46 in the base 41 with the resistance element 16 abutting the shoulder 25. A portion 24*a* of the end of the shaft 24 is heat swaged against the back surface of the base 41 to secure the base 41 to the support plate 12. As best seen in FIG. 3, in accord with the present invention, the base 41 does not require a conductive path or return overlapping the ends of any of the resistive paths. The resistance element 16 provides an electrically nonconductive surface overlying the support plate 12, and, as seen in FIGS. 2 and 5' with the base 41 secured to the support plate 12, contact 30 engages resistive path 50 and contact 30*a* engages resistive path 48. It should be understood that the resistance element 16 in FIG. 5 is shown partially in transparent form and the dotted lines illustrate the resistive paths 50 and 48 on the underside of the base 41 in engagement with contacts 30 and 30*a*. As the resistance element 16 is rotated, resistive path 50 rotates with respect to contact 30 and resistive path 48 rotates with respect to contact 30*a* providing a greater or lesser amount of resistance between contacts 30 and 30*a* and thus between terminals 40 and 40*a*.

Figure 6:
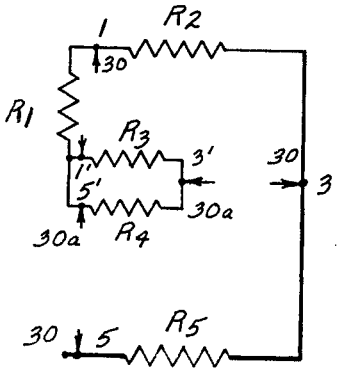
FIG. 6 is a schematic diagram illustrating the relationship of the contacts with respect to the resistive paths as the resistance element is rotated with respect to the contacts.

In operation with contact 30 at position 1 and contact 30*a* at position 1' as illustrated in FIGS. 3 and 6, there is a total resistance between contacts 30 and 30*a* approximately equal to the value of the resistive path 54 indicated as $R_1$ in FIG. 6. Rotating the resistance element approximately 180° with respect to contacts 30 and 30*a* places contact 30 at position 3 and contact 30*a* at position 3'. It can be seen in FIG. 3 that at position 3 and 3' the amount of resistance between contacts 30 and 30*a* is equal to the sum of resistance $R_1$ plus the equivalent resistance of the parallel branches of resistive path 48, indicated as $R_3$ and $R_4$ in FIG. 6, plus that portion of resistive path 50 between contact 30 and resistive path 54 indicated as $R_2$ in FIG. 6. When the resistance element 16 is rotated almost 360°, as illustrated in FIGS. 3 and 6 by contact 30 at position 5 and contact 30*a* at position 5', the total resistance between contacts 30 and 30*a* becomes approximately the total resistance of resistive paths 50 and 54 or $R_1 + R_2 + R_5$. At position 5', the contact 30*a* has rotated to the point where the resistance due to path 48 is almost negligible.

Figure 7:
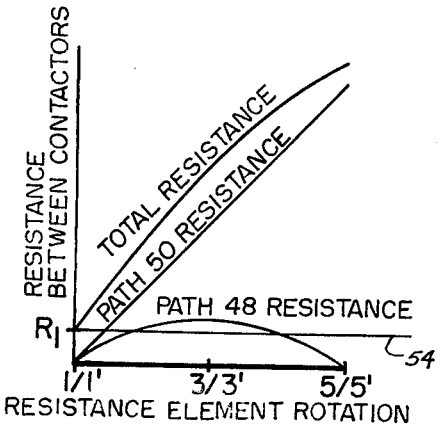
FIG. 7 is a graph of total resistance between contacts versus resistance element travel as the resistance element is rotated with respect to the contacts.

The relationship of the total resistance interposed between the contacts 30 and 30*a* as the resistive element is rotated with respect to contacts 30 and 30*a* is illustrated in FIG. 7. The ordinate represents the total amount of resistance interposed between the contacts 30 and 30*a* and the abscissa represents the position or rotation of the resistive paths 48 and 50 with respect to the contacts. The lower curve represents the changing parallel resistance of the contact 30*a* in engagement with the path 48 with respect to point 1', the middle line represents the linear resistance interposed by contact 30 engaging resistance path 50 with respect to point 1 and the line 54 represents the fixed resistance $R_1$ between points 1 and 1', and the upper curve represents the total of the three resistances. For example, at position 1/1' as illustrated in FIGS. 3 and 6, the interposed resistance is the value of the resistive path 54 or $R_1$. At position 3/3' or after a resistance element rotation of approximately 180°, the total resistance is approximately half the value of the resistance path 50 plus resistance $R_1$ plus the equivalent resistance value of the parallel paths of resistive path 48 from point 3' to point 1'. Position 5/5' illustrates the interposed resistance after rotation of approximately 360°. As seen in FIG. 7, the total resistance is resistance $R_1$ plus the total resistance of path 50.

From the above description, it is apparent that the variable resistance control can be rapidly assembled in production. For example, contact members 14 and 14*a* joined by bridging member 39 are aligned on the block 22 by engaging the center post 28 and end posts 26 with the notches 35, 35*a*, 36 and 36*a*. Portions of the posts are then heat swaged to secure the contact members to the block 22. Since no conductives are applied on the base 41 or the ends of the resistive paths, the resistance element 16 is prepared by one operation simultaneously applying the resistive films or paths 48, 50 and 54 on base 41. The shaft 24 is then inserted through the aperture in the resistance element 16 and a portion of the shaft is heat swaged against the back of the base 41 to secure the resistance element 16 to the support plate. The securement of the base 41 to the support plate 12 pushes the contacts 30 and 30*a* downwardly and the spring arms 32 and 32*a* bias the contacts 30 and 30*a* into engagement with the resistive paths 48 and 50.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent of the United States is:

1. In a variable resistance control, the combination of an electrically insulative frame, a shaft integral with the insulative frame, attachment means connected to the insulative frame, first and second contact means carried by the insulative frame and connected to the attachment means, a first terminal integral with the first contact means, a second terminal integral with the second contact means, an electrically nonconductive base rotatably supported by the shaft, a surface on the base disposed adjacent to the insulative frame, said first and second contact means being disposed intermediate the insulative frame and said surface, and a first and second resistive paths disposed on the surface, said first contact means engaging the first resistive path and said second contact means engaging the second resistive path, said second resistive path being electrically connected to said first resistive path, the resistance between the terminals being the sum of the resistance of the first and the second resistance paths between the first and the second contact means.

2. The variable resistance control of claim 1, wherein the base is provided with an aperture, said shaft extends through the aperture, said first and second resistive paths are disposed about said aperture, and a third resistive path disposed on the surface of the base forms the electrical connection between said second resistive path and one end of said first resistive path.

3. The variable resistance control of claim 1, wherein said attachment means comprises post members, portions of said post members engaging the contact means and securing the contact means to the frame.

4. In a variable resistance control, the combination of an electrically insulative support member having a first surface and a second surface spaced from the first surface, a pair of spaced electrically insulated resilient contact means carried by the support member, attachment means extending from the one of the surfaces and fixedly securing the contact means to the support member, an electrically nonconductive base rotatably carried by the support member, said base being provided with a surface disposed adjacent the contact means, first and second resistive paths electrically interconnected and disposed on the surface of the base, the base being provided with a centrally disposed aperture and each of said resistive paths being disposed in concentric relationship about said aperture, the first resistive patn being disposed near the periphery of the base and forming an arc having an angle less than 360 degrees, the second resistive path being disposed adjacent to and substantially around the aperture and within the first resistive path, both of the contact means extending from the one of the surfaces of the support member, said pair of resilient contact means electrically engaging the first and second resistive paths, the distance between the surface of the base and the first surface of the support member being greater than the distance between the surface of the base and the second surface of the support member to facilitate flexure of the contact means, and termination means connected to each of the contact means for connecting the resistive paths into an electrical circuit.

5. The variable resistance control of claim 4, wherein attachment means is integral with the frame and comprises a post extending from the frame, a portion of the post engaging the contact means and securing the contact means to the frame.

6. The variable resistance control of claim 5, wherein a portion of the post is heat swaged against the contact means.

7. The variable resistance control of claim 6, wherein the contact means is provided with a notch engaging said post for aligning the contact means with the frame.

8. The variable resistance control of claim 4, wherein the support member comprises a block, the first surface of the support member is a flat surface on the block, and the attachment means are integral with the block.

9. The variable resistance control of claim 4, wherein a hub is integral with the support member and supports the base, a shaft is integral with the hub and the support member and is eccentrically disposed with respect to the hub, and the shaft is received in the aperture of the base.

* * * * *